US009396677B2

(12) United States Patent
Park et al.

(10) Patent No.: US 9,396,677 B2
(45) Date of Patent: Jul. 19, 2016

(54) DISPLAY PANEL DRIVER, DISPLAY APPARATUS, AND RELATED CONTROL METHOD

(71) Applicant: Samsung Display Co., LTD., Yongin, Gyeonggi-Do (KR)

(72) Inventors: Jin-Woo Park, Cheonan-si (KR); Su-Min Yang, Goyang-si (KR)

(73) Assignee: SAMSUNG DISPLAY CO., LTD. (KR)

( * ) Notice: Subject to any disclaimer, the term of this patent is extended or adjusted under 35 U.S.C. 154(b) by 21 days.

(21) Appl. No.: 14/286,828

(22) Filed: May 23, 2014

(65) Prior Publication Data

US 2014/0375699 A1 Dec. 25, 2014

(30) Foreign Application Priority Data

Jun. 19, 2013 (KR) ..... 10-2013-0070114

(51) Int. Cl.
*G09G 3/32* (2016.01)

(52) U.S. Cl.
CPC ..... *G09G 3/3225* (2013.01); *G09G 3/3283* (2013.01); *G09G 2320/0285* (2013.01); *G09G 2320/0673* (2013.01)

(58) Field of Classification Search
CPC ..... G09G 3/3225
See application file for complete search history.

(56) References Cited

U.S. PATENT DOCUMENTS

| | | | | |
|---|---|---|---|---|
| 8,471,797 | B2 * | 6/2013 | Kim | G09G 3/342 345/87 |
| 2003/0067424 | A1 * | 4/2003 | Akimoto et al. | 345/55 |
| 2005/0184944 | A1 * | 8/2005 | Miyata et al. | 345/89 |
| 2009/0147032 | A1 * | 6/2009 | Kim | G09G 3/3225 345/690 |
| 2012/0062623 | A1 | 3/2012 | Kim | |
| 2012/0200608 | A1 | 8/2012 | Kim et al. | |

FOREIGN PATENT DOCUMENTS

| | | |
|---|---|---|
| KR | 10-2008-0002579 | 1/2008 |
| KR | 10-2009-0058788 | 6/2009 |
| KR | 10-2012-0028004 | 3/2012 |
| KR | 10-2012-0090635 | 8/2012 |

* cited by examiner

*Primary Examiner* — Sahlu Okebato
(74) *Attorney, Agent, or Firm* — Innovation Counsel LLP

(57) ABSTRACT

A display panel driver includes an adjustment value generation part configured to generate a first adjustment value and/or a second adjustment value based on pre-adjustment luminance values associated with pixels of a display panel, the pixels including a first pixel. The display panel driver further includes an adjustment part configured to receive image data associated with the first pixel for providing a first data signal. The adjustment part may generate the first data signal by adjusting the image data based on the first adjustment value if an input grayscale value associated with the first image data is greater than a reference value. The adjustment part may provide the image data as the first data signal or generate the first data signal by adjusting the image data based on the second adjustment value if the input grayscale value is equal to or less than the reference value.

20 Claims, 6 Drawing Sheets

DISPLAY PANEL DRIVER, DISPLAY APPARATUS, AND RELATED CONTROL METHOD

CROSS-REFERENCE TO RELATED APPLICATION(S)

This application claims priority under 35 USC §119 to and benefit of Korean Patent Applications No. 10-2013-0070114, filed on Jun. 19, 2013 in the Korean Intellectual Property Office (KIPO), the contents of which are incorporated herein by reference.

BACKGROUND

1. Technical Field

The invention is related to a display panel driver, a method for controlling a display panel using the display panel driver, and a display apparatus that includes the display panel driver.

2. Description of the Related Art

Generally, a display apparatus includes a display panel and a display panel driver. The display panel includes a plurality of gate lines, a plurality of data lines, and a plurality of pixels. The display panel driver includes a controller, a gate driver, and a data driver.

A pixel may include a plurality of transistors, a storage capacitor, and an organic light emitting element. Due to variation of threshold voltages of the transistors, luminance of the pixels may be different from each other. As a result, a conspicuous "stain" may appear in a displayed image and may negatively affect the quality of the displayed image.

A compensating grayscale may be used to compensate for the stain. Typically, stain compensation may be unsatisfactory at a relatively low grayscale.

SUMMARY

Some embodiments of the invention may be related to a display panel driver for controlling a display panel to display images with satisfactory quality. Some embodiments of the invention may be related to a method for controlling a display panel using the display panel driver. Some embodiments of the invention may be related to a display apparatus that includes the display panel driver.

According to some example embodiments, a display panel driver includes an adjustment value generating part and an adjustment part. The compensating value generates part is configured to generate an adjustment grayscale based on luminance values of pixels of a display panel. The adjustment part adjusts an input grayscale of the pixel to generate a data signal based on the adjustment grayscale when the input grayscale exceeds a reference grayscale.

In example embodiments, the adjustment grayscale may be determined such that the pixels having different luminance values to have a minimum luminance value of the pixels.

In example embodiments, when the input grayscale is equal to or less than the reference grayscale, the input grayscale may be not adjusted.

In example embodiments, when the input grayscale is equal to or less than the reference grayscale, the input grayscale may be commonly adjusted based on a common adjustment value.

In example embodiments, the common adjustment value may be determined such that the pixels having different luminance values to have an average luminance value of the pixels.

In example embodiments, the reference grayscale may be determined based on a maximum input grayscale having an adjustment error exceeding a luminance variation of the pixels.

In example embodiments, the reference grayscale may be determined based on a luminance uniformity of the pixels. The luminance uniformity may be determined by dividing the pixels into a plurality of pixel groups, calculating a ratio between the minimum luminance value and the maximum luminance value in the pixel group and averaging the ratios between the minimum luminance value and the maximum luminance value of the total pixel groups.

In example embodiments, the adjustment grayscale may be stored at an adjustment lookup table.

According to some example embodiments, a display apparatus includes a display panel and a display panel driver. The display panel includes a plurality of gate lines, a plurality of data lines and a plurality of pixels connected to the gate lines and the data lines. The display panel driver includes an adjustment value generating part and an adjustment part. The adjustment value generates part generating an adjustment grayscale based on luminance values of pixels of a display panel. The adjustment part adjusts an input grayscale of the pixel to generate a data signal based on the adjustment grayscale when the input grayscale exceeds a reference grayscale.

In example embodiments, the pixel may include a switching transistor including a control electrode connected to the gate line, an input electrode connected to the data line and an output electrode connected to a first node, a driving transistor including a control electrode connected to the first node, an input electrode connected to a second node and an output electrode connected to a first electrode of an organic light emitting element, a bias transistor including a control electrode to which a bias voltage is applied, an input electrode to which a high power voltage is applied and an output electrode connected to the second node, a first capacitor including a first end to which the high power voltage is applied and a second end connected to the first node, a second capacitor including a first end to which the high power voltage is applied and a second end connected to the control electrode of the bias transistor and the light organic light emitting element including the first electrode connected to the output electrode of the driving transistor and a second electrode to which a low power voltage is applied.

In example embodiments, the adjustment grayscale may be determined such that the pixels having different luminance values to have a minimum luminance value of the pixels.

In example embodiments, when the input grayscale is equal to or less than the reference grayscale, the input grayscale may be not adjusted.

In example embodiments, when the input grayscale is equal to or less than the reference grayscale, the input grayscale may be commonly adjusted based on a common adjustment value.

In example embodiments, the common adjustment value may be determined such that the pixels having different luminance values to have an average luminance value of the pixels.

In example embodiments, the reference grayscale may be determined based on a maximum input grayscale having a compensating error exceeding a luminance variation of the pixels.

In example embodiments, the reference grayscale may be determined based on a luminance uniformity of the pixels. The luminance uniformity may be determined by dividing the pixels into a plurality of pixel groups, calculating a ratio between the minimum luminance value and the maximum luminance value in the pixel group and averaging the ratios between the minimum luminance value and the maximum luminance value of the total pixel groups.

According to some example embodiments, a method of driving a display panel includes generating an adjustment grayscale based on luminance values of pixels of a display panel and adjusting an input grayscale of the pixel to generate a data signal based on the adjustment grayscale when the input grayscale exceeds a reference grayscale.

In example embodiments, the adjustment grayscale may be determined such that the pixels having different luminance values to have a minimum luminance value of the pixels.

In example embodiments, when the input grayscale is equal to or less than the reference grayscale, the input grayscale may be not adjusted.

In example embodiments, when the input grayscale is equal to or less than the reference grayscale, the input grayscale may be commonly adjusted based on a common adjustment value.

DETAILED DESCRIPTION OF EMBODIMENTS

Figure 1:
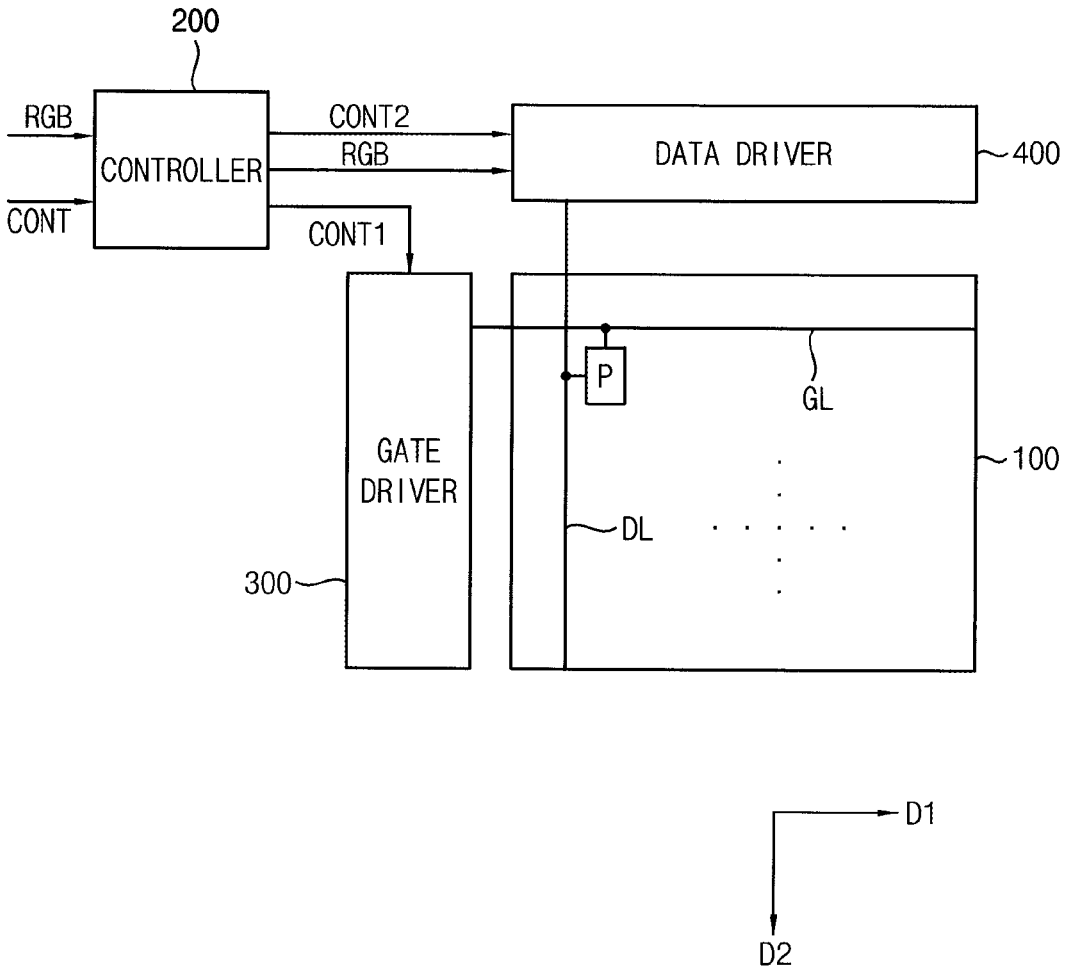
FIG. 1 is a block diagram illustrating a display apparatus according to example embodiments.

Example embodiments are described more fully hereinafter with reference to the accompanying drawings. The invention may be embodied in many different forms and should not be construed as limited to the example embodiments set forth herein. In the drawings, the sizes and relative sizes of layers and/or regions may be exaggerated for clarity.

In the description, if an element or layer is referred to as being "on," "connected to," or "coupled to" another element or layer, it can be directly on, directly connected to, or directly coupled to the other element or layer, or an intervening element or layer may be present. If an element is referred to as being "directly on," "directly connected to", or "directly coupled to" another element or layer, there are no intervening elements or layers (except possible environmental elements, such as air) present. Like or similar reference numerals may refer to like or similar elements in the description. As used herein, the term "and/or" may include any and all combinations of one or more of the associated items.

Although the terms "first", "second", etc. may be used herein to describe various signals, elements, components, regions, layers, and/or sections, these signals, elements, components, regions, layers, and/or sections should not be limited by these terms. These terms may be used to distinguish one signal, element, component, region, layer, or section from another signal, region, layer, or section. Thus, a first signal, element, component, region, layer, or section discussed below may be termed a second signal, element, component, region, layer, or section without departing from the teachings of the present invention. The description of an element as a "first" element may not require or imply the presence of a second element or other elements. The terms "first", "second", etc. may also be used herein to differentiate different categories of elements. For conciseness, the terms "first", "second", etc. may represent "first-type (or first-category)", "second-type (or second-category)", etc., respectively.

Spatially relative terms, such as "beneath," "below," "lower," "above," "upper", and the like, may be used herein for ease of description to describe one element or feature's relationship to another element(s) or feature(s) as illustrated in the figures. The spatially relative terms are intended to encompass different orientations of the device, e.g., when being in use or operation, in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations), and the spatially relative descriptors used herein should be interpreted accordingly.

The terminology used herein is for the purpose of describing particular example embodiments only and is not intended to limit the invention. As used herein, the singular forms "a," "an", and "the" may include plural forms as well, unless the context clearly indicates otherwise. The terms "comprises" and/or "comprising," when used in this specification, specify the presence of stated features, integers, steps, operations, elements, and/or components, but do not preclude the presence or addition of one or more other features, integers, steps, operations, elements, components, and/or groups.

Example embodiments should not be construed as limited to the particular shapes of regions illustrated herein. Embodiments of the invention may include deviations in shapes that are resulted, for example, from manufacturing. The regions illustrated in the figures are schematic in nature, and their shapes are not intended to limit the scope of the invention.

The term "connect" may mean "electrically connect".

Unless otherwise defined, all terms (including technical and scientific terms) used herein have the same meaning as commonly understood by one of ordinary skill in the art to which this invention belongs. Terms, such as those defined in commonly used dictionaries, should be interpreted as having meanings that are consistent with their meanings in the context of the relevant art and should not be interpreted in an idealized or overly formal sense unless expressly defined herein.

Various embodiments are described herein below, including methods and techniques. Embodiments of the invention might also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

FIG. 1 is a block diagram illustrating a display apparatus according to example embodiments.

Referring to FIG. 1, the display apparatus includes a display panel 100 and a display panel driver. The display panel driver includes a controller 200, a gate driver 300, and a data driver 400. For example, the display apparatus may be an organic light emitting display apparatus, a liquid crystal display apparatus, or a plasma display apparatus.

The display panel 100 includes a plurality of gate lines GL, a plurality of data lines DL, and a plurality of pixels P electrically connected to the gate lines GL and the data lines DL. The gate lines GL extend in a first direction D1. The data lines DL extend in a second direction D2 crossing the first direction D1. The pixels P may be disposed in a matrix form (e.g., a rectangular array).

The controller 200 may receive input image data RGB and an input control signal CONT from an external apparatus (not shown). For example, the input image data RGB may include red image data, green image data, and blue image data. The input image control signal CONT may include a master clock signal and a data enable signal. The input image control signal CONT may further include a vertical synchronizing signal and a horizontal synchronizing signal.

The controller 200 may generate a first control signal CONT1 and a second control signal CONT2 based on the input image data RGB and the input control signal CONT.

The controller 200 may output the first control signal CONT1 to the gate driver 300 for controlling the gate driver 300. The first control signal CONT1 may include a vertical start signal and a gate clock signal.

The controller 200 may output the second control signal CONT2 to the data driver 400 for controlling the data driver 400. The second control signal CONT2 may include a horizontal start signal and a load signal.

The controller 200 may output the input image data RGB to the data driver 400.

The gate driver 300 may generate gate signals in response to the first control signal CONT1 received from the controller 200. The gate driver 300 may sequentially output the gate signals to the gate lines GL for controlling the pixels P.

The gate driver 300 may be directly mounted on the display panel 100 or may be connected to the display panel 100 as a tape carrier package ("TCP"). In embodiments, the gate driver 300 may be integrated on a peripheral region of the display panel 100.

The data driver 400 may receive the second control signal CONT2 and the input image data RGB from the controller 200. The data driver 400 may use grayscale values of the input image data RGB to generate data signals. The data driver 400 may output the data signals to the data lines DL for controlling the pixels P. For example, a data signal may be a pulse width modulation signal.

The data driver 400 may be directly mounted on the display panel 100 or may be connected to the display panel 100 in a TCP. In embodiments, the data driver 400 may be integrated on the peripheral region of the display panel 100.

Figure 2:
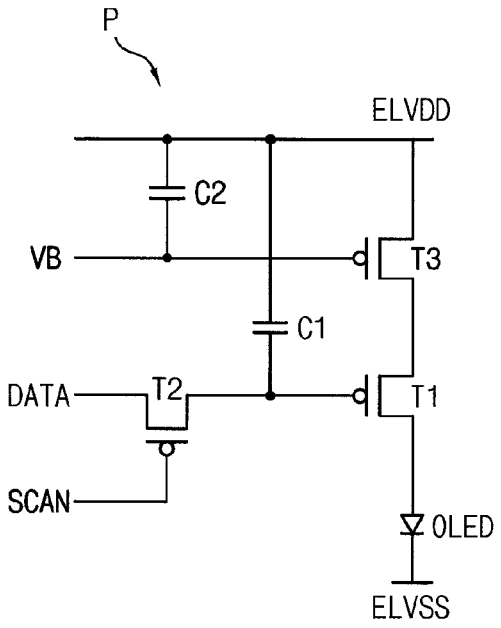
FIG. 2 is a circuit diagram illustrating a pixel of the display apparatus illustrated in FIG. 1 according to example embodiments.

FIG. 2 is a circuit diagram illustrating a pixel P of the display apparatus illustrated in FIG. 1 according to example embodiments.

Referring to FIGS. 1 and 2, the pixel P includes a switching transistor T2, a driving transistor T1, a bias transistor T3, a first capacitor C1, a second capacitor C2, and an organic light emitting element OLED.

The switching transistor T2 includes a control electrode connected to the gate line GL through which a gate signal SCAN is applied, an input electrode connected to the data line DL through which a data signal DATA is applied, and an output electrode connected to a control electrode of the driving transistor T1.

The switching transistor T2 may be turned on and turned off in response to the gate signal SCAN. When the switching transistor T2 is turned on, the data signal DATA is applied to the control electrode of the driving transistor T1. For example, the data signal DATA may be a pulse width modulation signal.

The control electrode of the switching transistor T2 may be a gate electrode. The input electrode of the switching transistor T2 may be a source electrode. The output electrode of the switching transistor T2 may be a drain electrode.

In example embodiments, the switching transistor T2 may be a P-type transistor. The switching transistor T2 may be turned on when the gate signal has a low level. In example embodiments, the switching transistor T2 may be an N-type transistor.

The driving transistor T1 includes a control electrode connected to the output electrode of the switching transistor T2, an input electrode connected to an output electrode of the bias transistor T3, and an output electrode connected to a first electrode of the organic light emitting element OLED.

The pixel P may be controlled in a digital driving method. The driving transistor T1 may operate in a linear region. The driving transistor T1 may be turned on and turned off in response to a voltage (e.g., of a pulse width modulation signal) at the control electrode of the driving transistor T1. When the driving transistor T1 is turned on, a high power voltage ELVDD may be applied through the bias transistor T3 and the driving transistor to the first electrode of the organic light emitting element OLED. A turn-on duration of the driving transistor T1 may be controlled according to on-duty of the pulse width modulation signal applied to the control electrode.

The control electrode of the driving transistor T1 may be a gate electrode. The input electrode of the driving transistor T1 may be a source electrode. The output electrode of the driving transistor T1 may be a drain electrode.

In example embodiments, the driving transistor T1 may be a P-type transistor. The driving transistor T1 may be turned on when the voltage at the control electrode of the driving transistor T1 is less than or equal to a turn-on voltage of the first driving transistor T1.

The bias transistor T3 includes a control electrode to which a bias voltage VB is applied, an input electrode to which the high power voltage ELVDD is applied, and an output electrode connected to the input electrode of the driving transistor T1.

The bias transistor T3 may operate in a saturation region. The bias transistor T3 may control an output current of the bias transistor T3 based on the bias voltage VB. The output current of the bias transistor T3 may be maintained at a substantially uniform level so that deterioration of the organic light emitting element OLED may be substantially prevented or delayed.

The control electrode of the bias transistor T3 may be a gate electrode. The input electrode of the bias transistor T3 may be a source electrode. The output electrode of the bias transistor T3 may be a drain electrode.

In example embodiments, the bias transistor T3 may be a P-type transistor. In example embodiments, the bias transistor T3 may be an N-type transistor.

The first capacitor C1 includes a first end (or first electrode) to which the high power voltage ELVDD may be applied and includes a second end (or second electrode) connected to the control electrode of the driving transistor T1.

The first capacitor C1 may be a storage capacitor. The first capacitor C1 may maintain the voltage at the control electrode of the driving transistor T1.

The second capacitor C2 includes a first end (or first electrode) to which the high power voltage ELVDD is applied and includes a second end (or second electrode) connected to the control electrode of the bias transistor T3.

The organic light emitting element OLED includes the first electrode connected to the output electrode of the driving transistor T1 and includes a second electrode to which a low power voltage ELVSS is applied.

When a difference between a voltage at the first electrode of the organic light emitting element OLED and a voltage at the second electrode of the organic light emitting element OLED is equal to or greater than a threshold voltage, the organic light emitting element OLED is turned on. When the difference between the voltage at the first electrode and the voltage at the second electrode is less than the threshold voltage, the organic light emitting element OLED is turned off.

Figure 3:
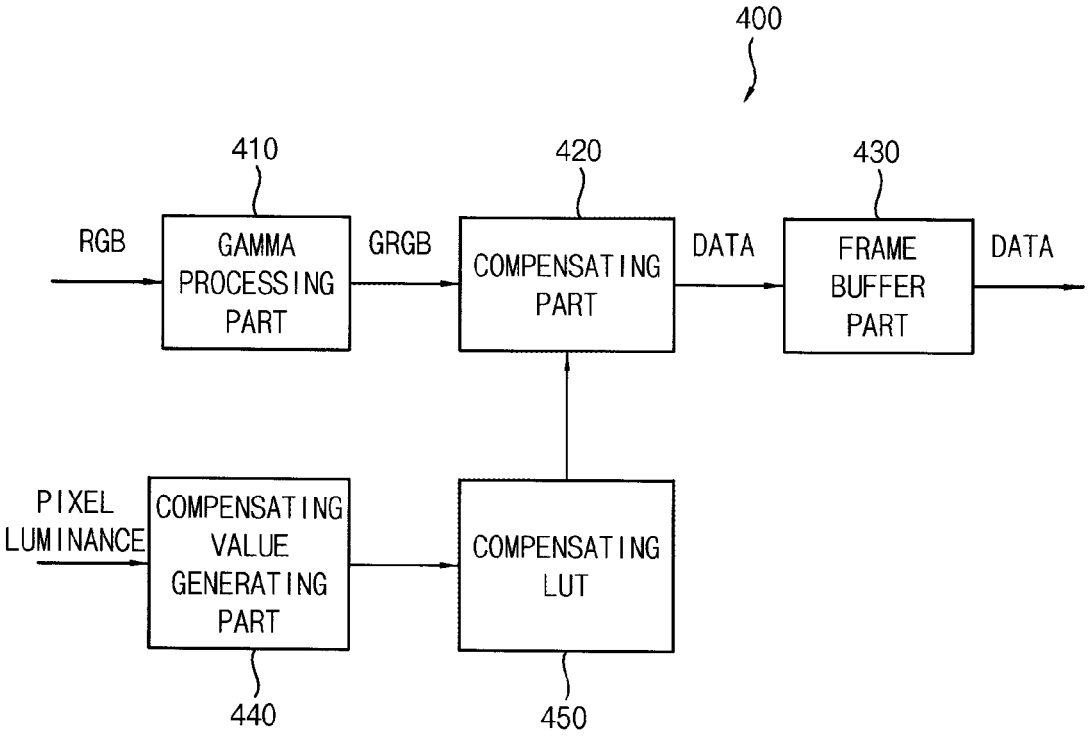
FIG. 3 is a block diagram illustrating a data driver of the display apparatus illustrated in FIG. 1 according to example embodiments.

FIG. 3 is a block diagram illustrating the data driver 400 illustrated in FIG. 1 according to example embodiments.

Referring to FIGS. 1 to 3, the data driver 400 includes a gamma processing part 410, a compensating part 420 (or adjustment part 420), a frame buffer part 430, and a compensating value generating part 440 (or adjustment value generation part 440). The data driver 400 may further include a compensating lookup table 450 (or adjustment lookup table 450).

The gamma processing part 410 may receive the input image data RGB. The gamma processing part 410 may perform a gamma conversion on the input image data RGB to generate a set of gamma image data GRGB. The gamma processing part 410 may output the gamma image data GRGB to the compensating part 420. In example embodiments, a gamma value of the gamma processing part 410 may be about 2.2.

The compensating part 420 may receive the gamma image data GRGB from the gamma processing part 410. The compensating part 420 may compensate (or adjust) the gamma image data GRGB to generate the data signal DATA based on a compensating value (or adjustment value) generated at the compensating value generating part 440 and/or the compensating lookup table 450. The compensating part 420 may output the data signal DATA to the frame buffer 430.

If an input grayscale value (associated with the gamma image data GRGB) is greater than a reference grayscale value, the compensating part 420 may compensate (or adjust) the input grayscale based on the adjustment value.

The compensating part 420 may compensate for a potential "stain" potentially caused by a difference of the luminances of the pixels of the display panel 100. In example embodiments, the compensating part 420 may perform compensation according to differences between threshold voltages of the bias transistors T3 of different pixels P.

The frame buffer part 430 may receive the data signal DATA from the compensating part 420. The frame buffer part 430 may buffer the data signal DATA and may output the data signal DATA to the display panel 100.

The compensating value generating part 440 may receive a luminance histogram of the pixels (P) of the display panel 100. The compensating value generating part 440 may generate an offset and a compensating grayscale based on the luminance histogram of the pixels.

Test image data may be inputted to the display panel 100 and the luminance of each pixel may be measured to determine the luminance histogram of the pixels of the display panel 100. For example, the test image data may represent a full white image.

In example embodiments, compensating value generating part 440 may set the compensating grayscale of the pixels such that the luminance values of all the pixels will be the minimum luminance value. For example, given the different threshold voltages of respective bias transistors T3, a first pixel may have a first luminance value, a second pixel may have a second luminance value, and a third pixel may have a third luminance, in response to the same input grayscale. If the first luminance value is the minimum luminance value among the three luminance values (i.e., the first luminance value, the second luminance value, and the third luminance value), the compensating grayscale may be set such that the first to third pixels will all have the first luminance value. The compensating grayscale may be stored at the compensating lookup table 450.

In example embodiments, the compensating grayscale may be set based on the minimum luminance value, the maximum luminance value, and the input grayscale. If the minimum luminance value is LMIN and if the maximum luminance value is LMAX, the compensating grayscale may have a value in a range from LMIN/LMAX to LMAX/LMAX.

For example, if the minimum luminance LMIN of the display panel 100 is 5048, if the maximum luminance LMAX of the display panel 100 is 10500, and if the number of bits of the compensating grayscale is 8, the compensating grayscale may have a value in a range from 123 (which is a 8-bit value corresponding to 5048/10500) to 255 (which is a 8-bit value corresponding to 10500/10500).

Figure 4:
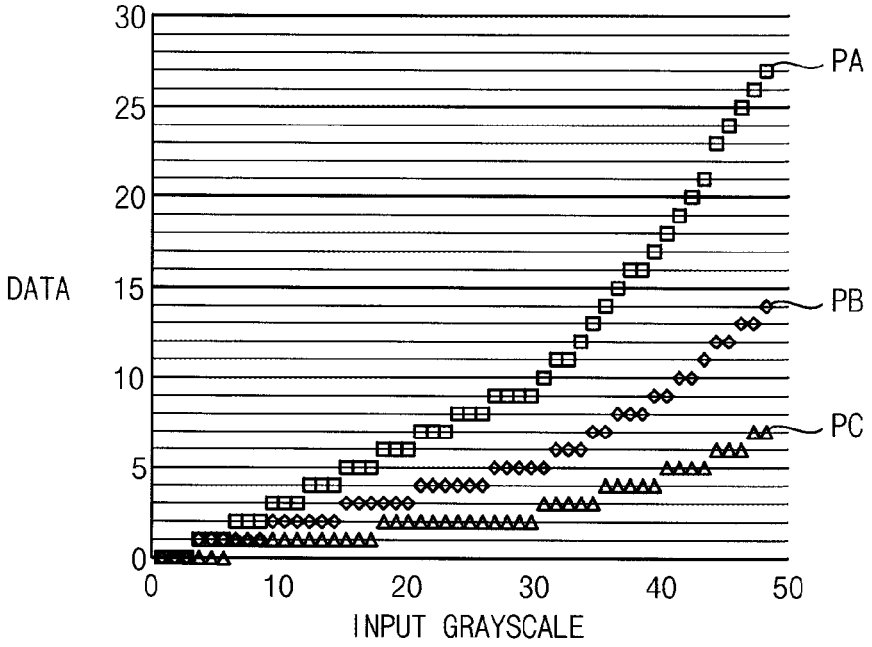
FIGS. 4 and 5 are graphs illustrating examples of data signals provided to pixels of the display apparatus illustrated in FIG. 1 according to input grayscale values according to example embodiments.
Figure 5:
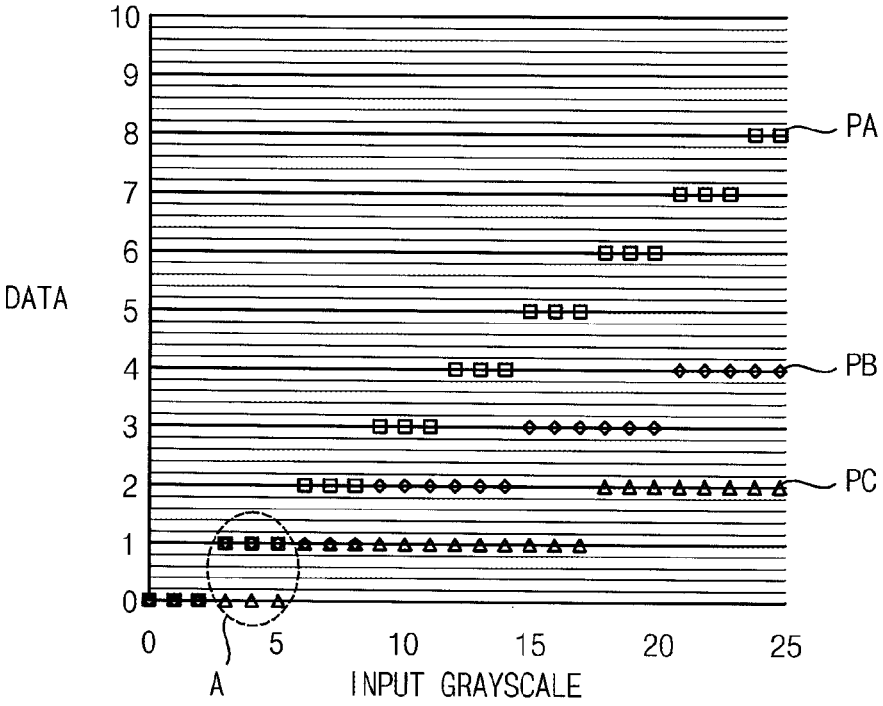
Figure 6:
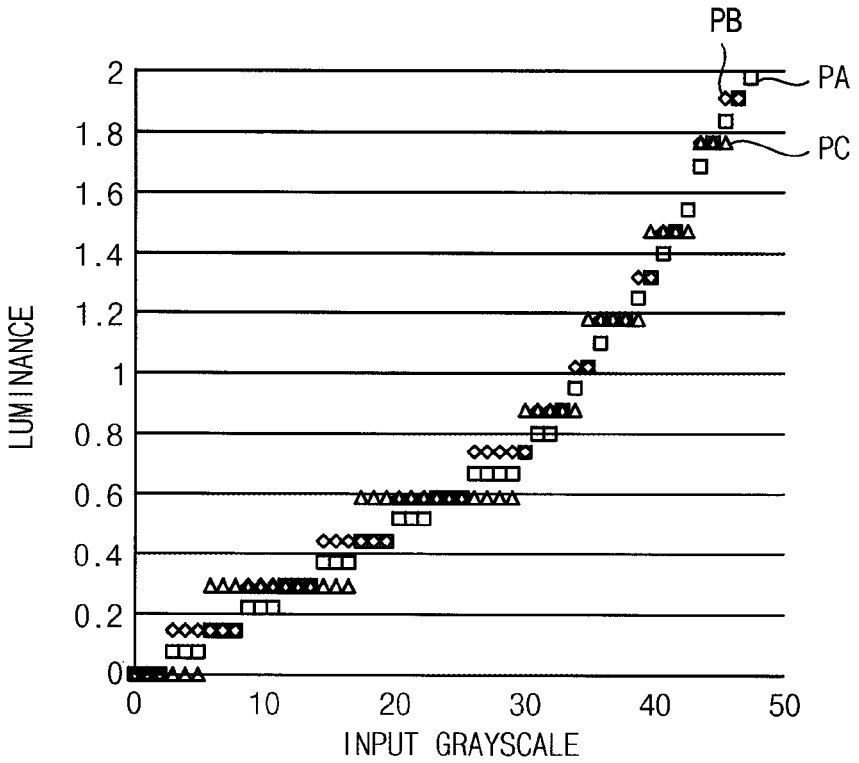
FIGS. 6 and 7 are graphs illustrating examples of luminance values of the pixels of the display apparatus illustrated in FIG. 1 according to input grayscale values according to example embodiments.
Figure 7:
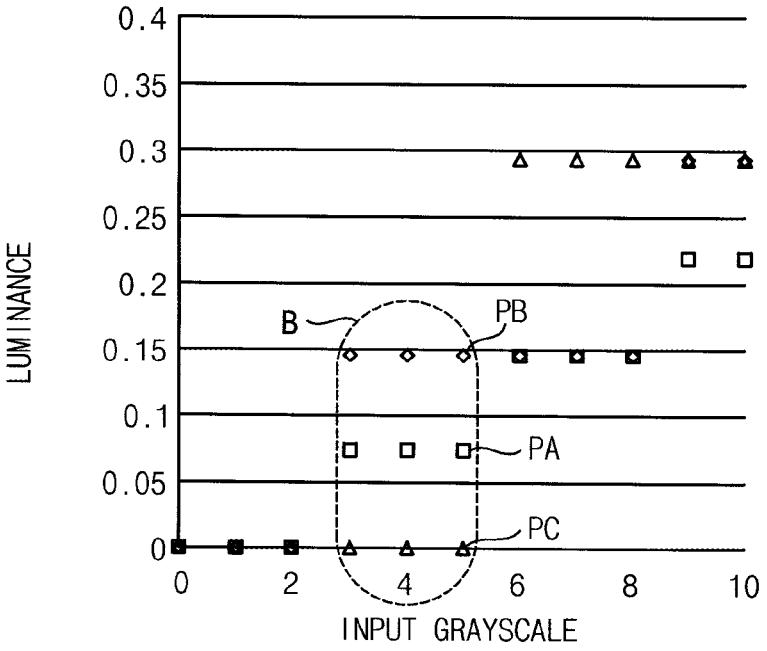

FIGS. 4 and 5 are graphs illustrating examples of data signals provided to pixels of the display apparatus illustrated in FIG. 1 according to example embodiments. FIGS. 6 and 7 are graphs illustrating examples of luminance values of the pixels of the display apparatus illustrated in FIG. 1 according to example embodiments.

The method discussed with reference to FIGS. 4 to 7 for minimizing or preventing stains in a displayed image may be applicable at both a relatively low grayscale and a relatively high grayscale. In the examples of FIGS. 4 and 5, the number of bits of the input grayscale is eight, and the input grayscale has a value in a range from 0 to 255. The data signal is a pulse width modulation signal of 10 bits, and the data signal has a value in a range from 0 to 1023. A first pixel PA represents a luminance of 75 nits corresponding to a grayscale value of 255. A second pixel PB represents a luminance of 150 nits corresponding to a grayscale value of 255. A third pixel PC represents a luminance of 300 nits corresponding to a grayscale value of 255. The first pixel PA represents a pixel that has a luminance value equal to the minimum luminance value of the pixels of the display panel 100. The second pixel PB represents a pixel that has a luminance value equal to the average luminance value of the pixels of the display panel 100. The third pixel PC represents a pixel that has a luminance value equal to the maximum luminance value of the pixels of the display panel 100.

The luminances of the pixels PA, PB, and PC may be adjusted to have the minimum luminance value, so that each of the pixels PA, PB, and PC has a luminance value of 75 nits corresponding to a grayscale value of 255 grayscale. FIGS. 6 and 7 illustrate that each of the pixels PA, PB, and PC has the same minimum luminance value.

FIG. 4 illustrates data signals corresponding to input grayscale values between 0 and 50 of the total input grayscale values in the range of 0 to 255. FIG. 5 illustrates data signals corresponding to input grayscale values between 0 and 25 of the total input grayscale values in the range of 0 to 255.

Referring to FIGS. 4 to 7, the first pixel PA already has the minimum luminance value, so that the data signal DATA of the first pixel PA may not need to be compensated (or adjusted) by the compensating part 420.

The data signal DATA (or the gamma image data GRGB and/or the associated luminance value) of the second pixel PB is adjusted such that the second pixel PB may have a luminance value that is substantially equal to the luminance value of the first pixel PA. If the second pixel PB and the first pixel PA have the same data signal DATA corresponding to the same grayscale value, the second pixel PB may have a luminance value greater than the luminance value of the first pixel PA. Thus, the data signal DATA of the second pixel PB is adjusted to be less than the data signal DATA of the first pixel PA corresponding to the same grayscale value.

The data signal DATA (or gamma image data GRGB) of the third pixel PC is adjusted such that the third pixel PC may have a luminance value that is substantially equal to the luminance value of the first pixel PA. If the third pixel PC and the first pixel PA have the same data signal DATA corresponding to the same grayscale value, the third pixel PC may have a luminance value greater than the luminance value of the first pixel PA. Thus, the data signal DATA of the third pixel PC is adjusted to be less than the data signal DATA of the first pixel PA corresponding to the same grayscale value.

Therefore, the luminance values of the pixels PA, PB and PC corresponding to the same grayscale value are adjusted to be equal.

At a relatively high grayscale value, the compensation (or adjustment) resolution discussed above may be sufficient. At the relatively low grayscale value, further adjustment may be desirable. As illustrated in FIG. 6, the luminances of the pixel PA, PB, and PC are substantially equal to one another or proximate to one another in a region corresponding to an input grayscale value of about 50. Analogously, the luminances of the pixel PA, PB, and PC may be substantially equal to one another in a region corresponding to an input grayscale value of about 255. Nevertheless, the luminances of the pixel PA, PB, and PC may be different from one another in a region corresponding to input grayscale values between 0 and 30, as shown in FIGS. 6 and 7.

In portion A indicated in FIG. 5, the third pixel PC, which is the brightest pixel, is compensated (or adjusted) to have the data signal DATA of 0 corresponding to input grayscale values in a range of 0 to 5. The second pixel PB, which has a relatively low luminance, is compensated (or adjusted) to have the data signal DATA of 0 corresponding to input grayscale values in a range of 0 to 2.

Thus, in portion B indicated in FIG. 7, the second pixel PB has a luminance of about 0.15 nit corresponding to input grayscale values in a range of 3 to 5; the third pixel PC has a luminance of 0 corresponding to input grayscale values in a range of 3 to 5. If a specific pixel (e.g. PB) has substantial luminance and if a specific pixel (e.g. PC) is completely turned off, a stain in the displayed image may be substantially conspicuous.

Figure 8:
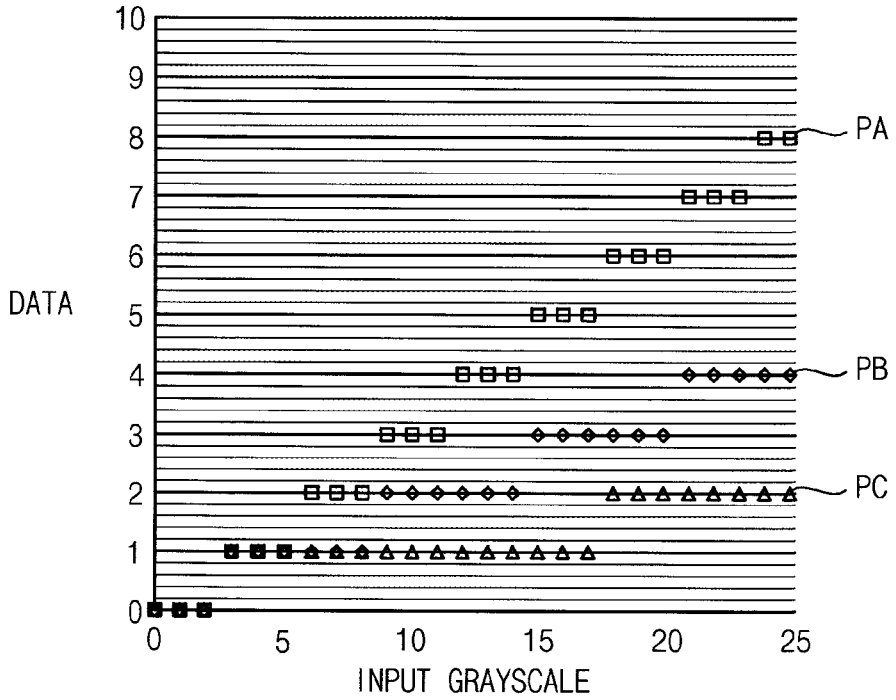
FIG. 8 is a graph illustrating examples of data signals provided to pixels of the display apparatus illustrated in FIG. 1 according to input grayscale values according to example embodiments.
Figure 9:
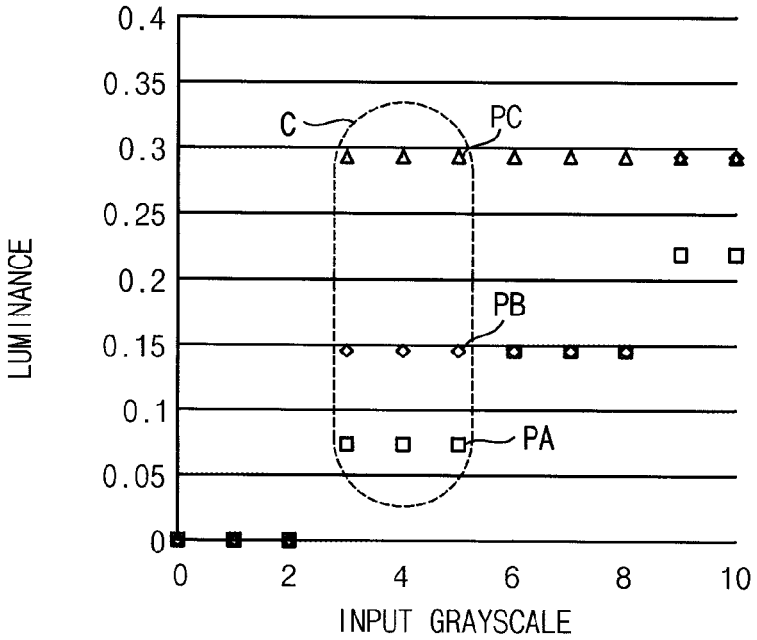
FIG. 9 is a graph illustrating examples of luminances of the pixels of the display apparatus illustrated in FIG. 1 according to input grayscale values according to example embodiments.

FIG. 8 is a graph illustrating examples of data signals provided to pixels of the display apparatus illustrated in FIG. 1 according to embodiments. FIG. 9 is a graph illustrating examples of luminances of the pixels of the display apparatus illustrated in FIG. 1 according to example embodiments.

Some features of example embodiments discussed with reference to FIGS. 8 and 9 may be analogous or identical to some features of example embodiments discussed with reference to FIGS. 4 to 7. In example embodiments, as discussed with reference to FIGS. 8 and 9, the compensating part 420 may not compensate (or adjust) the data signal DATA if the input grayscale is equal to or less than a reference grayscale value. In example embodiments, the reference grayscale value may be 5.

Referring to FIGS. 8 and 9, the data signal DATA of the second pixel PB and the data signal DATA of the third pixel PC corresponding to input grayscale values between 0 and 5 may not be adjusted.

Unlike portion A indicated in FIG. 5, as illustrated in FIG. 8, the pixels PA, PB, and PC may have the same data signal DATA corresponding to input grayscale values in a range of 0 to 5. For example, the data signal DATA is 0 corresponding to input grayscale values in a range of 0 to 2. The data signal DATA is 1 corresponding to input grayscale values in a range of 3 to 5.

In portion indicated in FIG. 9, the second pixel PB has a luminance of about 0.15 nit corresponding to input grayscale values in a range of 3 to 5; the third pixel PC has a luminance of about 0.3 nit (without being completely turned off) corresponding to input grayscale values in a range of 3 to 5.

According to example embodiments, the pixels PA, PB, and PC may be substantially concurrently (i.e., substantially simultaneously) turned on and off corresponding to the same input grayscale value so that a potential conspicuous stain possibly caused by that a specific pixel is turned on and that another pixel is turned off may be prevented.

The reference grayscale value may be determined based on the maximum input grayscale value corresponding to a luminance difference that is equal to or exceeds a maximum acceptable luminance variation of the pixels.

The reference grayscale may be set based on a luminance uniformity of the pixels. An average luminance uniformity is determined by dividing the pixels into a plurality of pixel groups, calculating a ratio between the minimum luminance and the maximum luminance in each pixel group to obtain group luminance uniformities, and averaging the group luminance uniformities (i.e., the ratios between the minimum luminance and the maximum luminance of the pixel groups). The average luminance uniformity is called to short range uniformity ("SRU").

For example, the display panel 100 may be divided into pixel groups of two-by-two matrices. A group luminance uniformity, i.e., a ratio between the minimum luminance and the maximum luminance in four pixels in the two-by-two matrix, is determined. In the same way, the group luminance uniformities (i.e., the ratios between the minimum luminance and the maximum luminance) for all of the pixel groups are determined. The group luminance uniformities (i.e., the ratios between the minimum luminance and the maximum luminance) of the pixel groups are averaged to determine the average luminance uniformity. If the average luminance uniformity is close to one, the pixels have a relatively high uniformity. In contrast, if the average luminance uniformity is close to zero, the pixels have a relatively low uniformity.

If data signal adjustment causes a luminance difference to exceed the maximum acceptable luminance variation, the luminance uniformity may be below a minimum acceptable value and may be unacceptable. Thus, the data signal (or luminance) may not be adjusted for input grayscale values that are lower than or equal to the reference grayscale, so that conspicuous stains may be prevented.

In example embodiments, the minimum acceptable group luminance uniformity of the first to third pixels may be 75/300=0.25. Referring again to portion B indicated in FIG. 7, the group luminance uniformity of the first to third pixels corresponding to input grayscale values in a range of 3 to 5 may be 0/0.15=0, which is less than the minimum acceptable group luminance uniformity 0.25. Referring to FIG. 7, the group luminance uniformity of the first to third pixels corresponding to input grayscale value of 6 may be 0.15/0.3=0.5, which is greater than the minimum acceptable group luminance uniformity 0.25. Thus, the reference grayscale value may be set to 5. Data signals corresponding to input grayscale values that are equal to or less than 5 may not be adjusted.

According to example embodiments, if the input grayscale value exceeds the reference grayscale value, the compensating part 420 may adjust the input image data RGB or the gamma image data GRGB based on the compensating grayscale to generate the data signal. If the input grayscale value is equal to or less than the reference grayscale value, the compensating part 420 may not adjust the input image data RGB or the gamma image data GRGB. Thus, conspicuous stains may be substantially prevented at the relatively low grayscale. Therefore the display quality of the display apparatus may be satisfactory.

Figure 10:
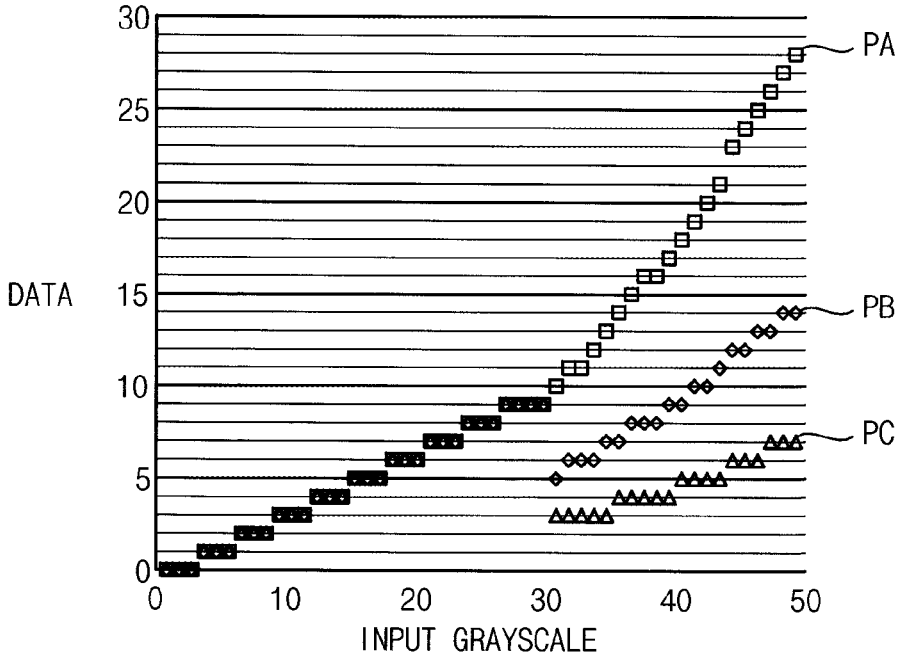
FIG. 10 is a graph illustrating examples of data signals provided to pixels of a display panel according to input grayscale values according to example embodiments.

FIG. 10 is a graph illustrating examples of data signals provided to pixels of a display panel according to input grayscale values according to example embodiments.

Some features of the display apparatus and the method discussed with reference to FIG. 10 may be substantially analogous to or substantially identical to some features of the display apparatus and the method explained with reference to FIGS. 1 to 9. Thus, same reference numerals will be used to refer to the same or like parts as those described in the example embodiments of FIGS. 1 to 9, and repetitive explanation concerning elements that have been explained may be omitted.

In example embodiments, as illustrated in FIG. 10, the reference grayscale value may be 30.

Referring to FIGS. 1 to 7 and 10, the data signal DATA (or the gamma image data GRGB) of the second pixel PB and the data signal DATA (or the gamma image data GRGB) of the third pixel PC corresponding to input grayscale values in a range of 0 to 30 may not be adjusted. Thus, the pixels PA, PB, and PC may have the same data signal DATA corresponding to input grayscale values in the range of 0 to 30.

Accordingly, the third pixel PC may have the highest luminance among the pixels PA, PB, and PC; the second pixel PB may have the middle luminance among the pixels PA, PB, and PC; and the first pixel PA may have the lowest luminance among the pixels PA, PB, and PC corresponding to input grayscale values in the range of 0 to 30. For input grayscale values that are equal to or greater than 31, each of the pixels PA, PB, and PC may have the same luminance value that is equal to the luminance value of the first pixel PA before the adjustments of the gamma image data of the pixels PB and PC.

According to example embodiments, the pixels PA, PB, and PC may be concurrently turned on and off corresponding to the same input grayscale value, so that potential conspicuous stains potentially caused by substantial differences between luminance values of turned-on pixels and turned-off pixels may be prevented.

According to example embodiments, if the input grayscale value exceeds the reference grayscale value, the compensating part 420 may adjust gamma image data GRGB based on an adjustment value to generate data signal DATA. If the input grayscale value is equal to or less than the reference grayscale value, the compensating part 420 may not adjust the gamma image data GRGB. Thus, stains may be effectively prevented at the relatively low grayscale. Therefore the display quality of the display apparatus may be satisfactory.

Figure 11:
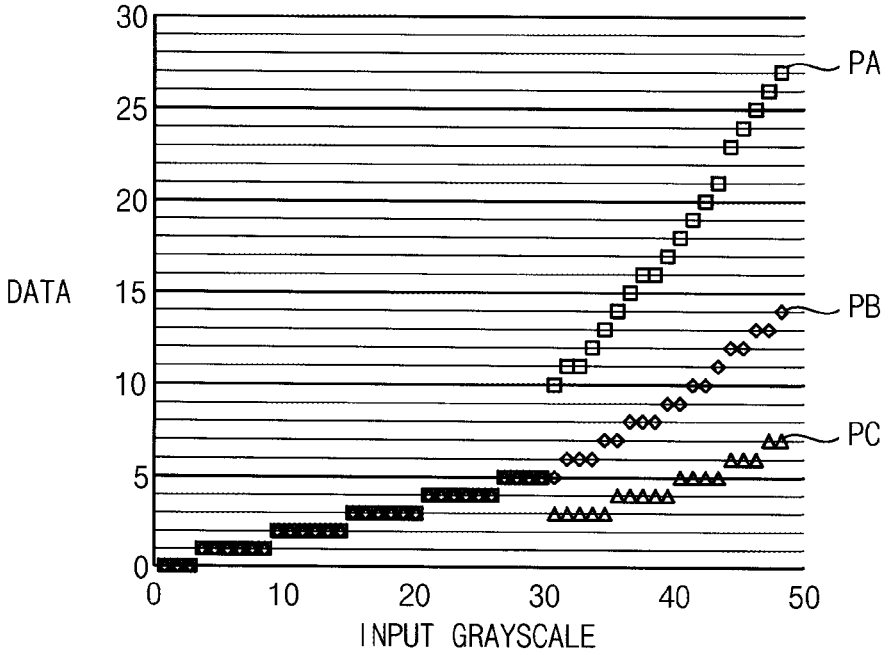
FIG. 11 is a graph illustrating examples of data signals provided to pixels of a display panel according to input grayscale values according to example embodiments.

FIG. 11 is a graph illustrating examples of data signals provided to pixels of a display panel according to input grayscale values according to example embodiments.

Some features of the display apparatus and the method discussed with reference to FIG. 10 may be substantially analogous to or substantially identical to some features of the display apparatus and the method explained with reference to FIGS. 1 to 9. Thus, same reference numerals will be used to refer to the same or like parts as those described in the example embodiments of FIGS. 1 to 9, and repetitive explanation concerning elements that have been explained may be omitted.

In example embodiments, as illustrated in FIG. 11, the reference grayscale value may be 30.

Referring to FIGS. 1 to 7 and 11, if the input grayscale value of a pixel exceeds the reference grayscale value, the compensating part 420 may adjust the gamma image data GRGB based on an adjustment value to generate the data signal DATA.

If the input grayscale value is equal to or less than the reference grayscale value, the compensating part 420 may adjust the gamma image data GRGB of a plurality of pixels based on a common adjustment value. For example, the common adjustment value may be set such that the luminance value of each pixel of the plurality of pixels after the adjustments may be equal to the average luminance value of the pixels before the adjustments.

In example embodiments, the gamma image data GRRB of each of the first pixel PA, the second pixel PB, and the third pixel PC is adjusted based on the common adjustment value for input grayscale values in the range of 0 to 30. The common adjustment value may be set based on the pre-adjustment luminance value of the second pixel PB, which corresponds to the average luminance value of the pixels before the adjustments. Thus, the pixels PA, PB, and PC may have the same data signal DATA for grayscale values in the range of 0 to 30.

Accordingly, the third pixel PC may have the highest luminance among the pixels PA, PB, and PC; the second pixel PB may have the middle luminance among the pixels PA, PB, and PC; and the first pixel PA may have the lowest luminance among the pixels PA, PB, and PC corresponding to input grayscale values in the range of 0 to 30. For input grayscale values that are equal to or greater than 31, each of the pixels PA, PB, and PC may have the same luminance value that is equal to the luminance of the first pixel PA before the adjustments of the gamma image data of the pixels PB and PC.

According to example embodiments, the pixels PA, PB, and PC may be concurrently turned on and off corresponding to the same input grayscale value, so potential conspicuous stains potentially caused by substantial differences between luminance values of turned-on pixels and turned-off pixels may be prevented.

According to example embodiments, if the input grayscale value exceeds the reference grayscale value, the compensating part 420 may adjust gamma image data GRGB based on an adjustment value to generate data signal DATA. If the input grayscale value is equal to or less than the reference grayscale value, the compensating part 420 may adjust the gamma image data GRGB based on the common adjustment value. Thus, stains may be effectively prevented at the relatively low grayscale. Therefore the display quality of the display apparatus may be satisfactory.

Embodiments of the present invention may be related to a display panel driver that may compensate for luminance variation to improve display quality of a display panel, a display apparatus that includes the display panel driver, and a display system that includes the display apparatus. For example, embodiments of the present invention may be related to one or more of an organic light emitting display apparatus and a liquid crystal display apparatus. For example, embodiments of the present invention may be related to one or more of a cellular phone, a smart phone, a personal digital assistant (PDA), a computer monitor, a laptop computer, a portable multimedia player (PMP), a television, a digital camera, a MP3 player, a navigation system, a video phone, etc.

The foregoing is illustrative of example embodiments and is not to be construed as limiting. Although a few example embodiments have been described, those skilled in the art will readily appreciate that many modifications are possible in the example embodiments and/or other embodiments without materially departing from the novel teachings and advantages of the present invention. All such modifications are intended to be included within the scope of the present invention as defined in the claims.

What is claimed is:

1. A display panel driver comprising:

an adjustment value generating part configured to generate an adjustment grayscale based on luminance values of pixels of a display panel; and an adjustment part configured to adjust an input grayscale of the pixels to generate a data signal based on the adjustment grayscale when the input grayscale exceeds a reference grayscale, wherein the pixels include a first pixel and a second pixel, wherein the first pixel has a first luminance value and the second pixel has a second luminance value different from the first luminance value for the same input grayscale, wherein when the input grayscale is equal to or less than the reference grayscale, the first pixel and the second pixel have the same data signal, wherein when the input grayscale exceeds the reference grayscale, the first pixel and the second pixel have different data signals.

2. The display panel driver of claim 1, wherein the luminance values include a minimum luminance value, and wherein the adjustment grayscale is determined such that each of the pixels will have the minimum luminance value.

3. The display panel driver of claim 1, wherein when the input grayscale is equal to or less than the reference grayscale, the input grayscale is not adjusted.

4. The display panel driver of claim 1, wherein when the input grayscale is equal to or less than the reference grayscale, the input grayscale is commonly adjusted based on a common adjustment value.

5. The display panel driver of claim 4, wherein the common adjustment value is determined such that the pixels having different luminance values to have an average luminance value of the pixels.

6. The display panel driver of claim 1, wherein the reference grayscale is determined based on a maximum input grayscale having an adjustment error exceeding a luminance variation of the pixels.

7. The display panel driver of claim 6, wherein the reference grayscale is determined based on a luminance uniformity of the pixels, the luminance uniformity is determined by dividing the pixels into a plurality of pixel groups, calculating a ratio between the minimum luminance value and the maximum luminance value in the pixel group and averaging the ratios between the minimum luminance value and the maximum luminance value of the total pixel groups.

8. The display panel driver of claim 1, wherein the adjustment grayscale is stored at an adjustment lookup table.

9. A display apparatus comprising:

a display panel comprising a plurality of gate lines, a plurality of data lines, and a plurality of pixels connected to the gate lines and the data lines; and a display panel driver comprising an adjustment value generating part configured to generate an adjustment grayscale based on luminance values of the pixels and an adjustment part configured to adjust an input grayscale of the pixels to generate a data signal based on the adjustment grayscale when the input grayscale exceeds a reference grayscale, wherein the pixels include a first pixel and a second pixel, wherein the first pixel has a first luminance value and the second pixel has a second luminance value different from the first luminance value for the same input grayscale, wherein when the input grayscale is equal to or less than the reference grayscale, the first pixel and the second pixel have the same data signal, wherein when the input grayscale exceeds the reference grayscale, the first pixel and the second pixel have different data signals.

10. The display apparatus of claim 9, wherein the pixel comprises:

a switching transistor including a control electrode connected to the gate line, an input electrode connected to the data line and an output electrode connected to a first node;

a driving transistor including a control electrode connected to the first node, an input electrode connected to a second node and an output electrode connected to a first electrode of an organic light emitting element;

a bias transistor including a control electrode to which a bias voltage is applied, an input electrode to which a high power voltage is applied and an output electrode connected to the second node;

a first capacitor including a first end to which the high power voltage is applied and a second end connected to the first node;

a second capacitor including a first end to which the high power voltage is applied and a second end connected to the control electrode of the bias transistor; and the light organic light emitting element including the first electrode connected to the output electrode of the driving transistor and a second electrode to which a low power voltage is applied.

11. The display apparatus of claim 9, wherein the luminance values include a minimum luminance value, and wherein the adjustment grayscale is determined such that each of the pixels will have the minimum luminance value.

12. The display apparatus of claim 9, wherein when the input grayscale is equal to or less than the reference grayscale, the input grayscale is not adjusted.

13. The display apparatus of claim 9, wherein when the input grayscale is equal to or less than the reference grayscale, the input grayscale is commonly adjusted based on a common adjustment value.

14. The display apparatus of claim 13, wherein the common adjustment value is determined such that the pixels having different luminance values to have an average luminance value of the pixels.

15. The display apparatus of claim 9, wherein the reference grayscale is determined based on a maximum input grayscale having an adjustment error exceeding a luminance variation of the pixels.

16. A method of driving a display panel, the method comprising:

generating an adjustment grayscale based on luminance values of pixels of a display panel; and adjusting an input grayscale of the pixels to generate a data signal based on the adjustment grayscale when the input grayscale exceeds a reference grayscale, wherein the pixels include a first pixel and a second pixel, wherein the first pixel has a first luminance value and the second pixel has a second luminance value different from the first luminance value for the same input grayscale, wherein when the input grayscale is equal to or less than the reference grayscale, the first pixel and the second pixel have the same data signal, wherein when the input grayscale exceeds the reference grayscale, the first pixel and the second pixel have different data signals.

17. The method of claim 16, wherein the luminance values include a minimum luminance value, and wherein the adjustment grayscale is determined such that each of the pixels will have the minimum luminance value.

18. The method of claim 16, wherein when the input grayscale is equal to or less than the reference grayscale, the input grayscale is not adjusted.

19. The method of claim 16, wherein when the input grayscale is equal to or less than the reference grayscale, the input grayscale is commonly adjusted based on a common adjustment value.

20. A display panel driver comprising:

an adjustment value generation part configured to generate at least one of a first adjustment value and a second adjustment value based on pre-adjustment luminance values associated with a plurality of pixels of a display panel, the plurality of pixels including a first pixel and a second pixel; and an adjustment part configured to receive first image data associated with the first pixel for providing a first data signal, wherein the adjustment part is configured to generate the first data signal by adjusting the first image data based on the first adjustment value if an input grayscale value associated with the first image data is greater than a reference grayscale value, and wherein the adjustment part is configured to provide the first image data as the first data signal or to generate the first data signal by adjusting the first image data based on the second adjustment value if the input grayscale value is equal to or less than the reference grayscale value, wherein the first pixel has a first luminance value and the second pixel has a second luminance value different from the first luminance value for the same input grayscale, wherein when the input grayscale is equal to or less than the reference grayscale value, the first pixel and the second pixel have the same data signal, and wherein when the input grayscale exceeds the reference grayscale value, the first pixel and the second pixel have different data signals.

* * * * *